US006407051B1

(12) United States Patent
Smith et al.

(10) Patent No.: US 6,407,051 B1
(45) Date of Patent: Jun. 18, 2002

(54) MICROEMULSION DETERGENT COMPOSITION AND METHOD FOR REMOVING HYDROPHOBIC SOIL FROM AN ARTICLE

(75) Inventors: Kim Smith, Woodbury; Wendy Wiseth, St. Paul, both of MN (US); Robert D.P. Hei, Baldwin, WI (US); David Falbaum, Minneapolis, MN (US); Paul Mattia, Prior Lake, MN (US); Victor F. Man, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/499,140

(22) Filed: Feb. 7, 2000

(51) Int. Cl.[7] ..... C11D 1/68; C11D 3/18

(52) U.S. Cl. ..... 510/417; 510/109; 510/238; 510/277; 510/365; 510/424; 424/70.19; 424/74

(58) Field of Search ..... 510/109, 417, 510/365, 277, 424, 238; 424/70.19, 74

(56) References Cited

U.S. PATENT DOCUMENTS

| | | | | |
|---|---|---|---|---|
| 4,363,756 | A | | 12/1982 | Sepulveda et al. |
| 4,877,556 | A | | 10/1989 | Wilsberg et al. |
| 4,909,962 | A | | 3/1990 | Clark |
| 5,415,813 | A | | 5/1995 | Misselyn et al. |
| 5,523,000 | A | | 6/1996 | Falbaum et al. |
| 5,523,014 | A | | 6/1996 | Dolan et al. |
| 5,597,792 | A | | 1/1997 | Klier et al. |
| 5,616,548 | A | | 4/1997 | Thomas et al. |
| 5,635,462 | A | | 6/1997 | Fendler et al. |
| 5,712,241 | A | | 1/1998 | Gorlin et al. |
| 5,734,029 | A | | 3/1998 | Wulff et al. |
| 5,741,768 | A | | 4/1998 | Falbaum et al. |
| 5,858,954 | A | | 1/1999 | Balzer |
| 5,891,836 | A | * | 4/1999 | Kacher |
| 6,004,920 | A | | 12/1999 | Pollack et al. |
| 6,008,180 | A | | 12/1999 | Drapier et al. |

FOREIGN PATENT DOCUMENTS

| | | | |
|---|---|---|---|
| EP | 0 842 606 A1 | | 5/1998 |
| JP | 407002615 A | * | 1/1995 |
| WO | WO 97/32967 | | 9/1997 |

OTHER PUBLICATIONS

Search Report containing abstracts, pp. 7–90 including non–duplicate pp. 26,35,58, and 70 (1998).

* cited by examiner

*Primary Examiner*—Yogendra N. Gupta
*Assistant Examiner*—Gregory E. Webb
(74) *Attorney, Agent, or Firm*—Merchant & Gould P.C.

(57) ABSTRACT

The invention relates to microemulsion compositions containing water, a mixture of nonionic surfactants, and oil. The microemulsion provides for the removal of hydrophobic particularly oily soils from a variety of substrates. The compositions can be used for hard surface, laundry cleaning, hand washing, and car washing. Typical hydrophobic soils are oily based soils derived from petroleum oils or natural fats and oils also containing a significant proportion of particulate soils such as carbon, common dirt and other non-water soluble typically hydrophobic soil particulate. The microemulsion composition can include a splitting agent such as an amphoteric surfactant for controlling the conditions under which the microemulsion will split.

27 Claims, No Drawings

MICROEMULSION DETERGENT COMPOSITION AND METHOD FOR REMOVING HYDROPHOBIC SOIL FROM AN ARTICLE

FIELD OF THE INVENTION

The invention relates to microemulsion detergent compositions and methods for removing hydrophobic soil from a variety of articles. In particular, the invention relates to a microemulsion detergent composition including water, oil, and a blend of nonionic surfactants. Articles that can be cleaned using the microemulsion detergent compositions of the invention include hard surfaces, textiles, skin, and hair. The invention additionally relates to controlling the stability of a microemulsion detergent composition over a broad temperature range.

BACKGROUND OF THE INVENTION

Microemulsions are disclosed for soil removal. For example, U.S. Pat. No. 4,909,962 to Clark describes a substantially clear microemulsion material that can be used in a variety of cleaning applications. The material can be diluted with water to form a use solution.

While microemulsion cleaning technology has proved useful as a vehicle for delivering typically anionic, nonionic or anionic amine oxide surfactant blends to a cleaning location, the typical microemulsion compositions do not provide desired soil removal when challenged with a strongly hydrophobic soil and in particular, a strongly hydrophobic soil containing a substantial quantity of hydrophobic particulate material. Particularly difficult hydrophobic soils include hydrophobic petroleum based lubricant or oil and used motor oil containing carbonaceous particulates.

Examples of microemulsion detergent technology are found in U.S. Pat. No. 5,597,792 to Klier et al.; U.S. Pat. No. 5,415,813 to Misselyn et al.; U.S. Pat. No. 5,523,014 to Dolan et al.; and U.S. Pat. No. 5,616,548 to Thomas et al. In general, microemulsions including anionic or cationic surfactants are described by these patents.

Many prior art microemulsions are stable at a fairly narrow temperature range. Under low temperature and high temperature conditions often encountered when shipping product or storing product in a warehouse, microemulsions exhibiting stability in a fairly narrow temperature range tend to become unstable. As a result, the microemulsion breaks and the effectiveness of the composition for removing soil is decreased. In addition, when a microemulsion breaks, it may take a considerable amount of time for the microemulsion to reform. In general, cleaning operations until a composition forms a microemulsion in order to obtain optimum cleaning benefits.

SUMMARY OF THE INVENTION

A microemulsion detergent composition is provided by the invention. The microemulsion detergent composition includes an effective microemulsion forming amount of water, an effective microemulsion forming amount of a nonionic surfactant mixture, and an effective microemulsion forming amount of oil. The microemulsion detergent composition can be characterized as exhibiting at least a 90% transmission of visible light through a 1 cm cell. In addition, the microemulsion detergent composition is preferably one which will maintain a microemulsion as a concentrate containing 30 wt. % water, and will maintain a microemulsion as a use solution at 99 wt. % water. In addition, the microemulsion detergent composition preferably maintains a microemulsion stability range of at least about 10° C.

The nonionic surfactant mixture preferably includes an alcohol ethoxylate surfactant and an alkyl polyglucoside surfactant. The alcohol ethoxylate surfactant is preferably a $C_{6-24}$ alcohol ethoxylate surfactant having between about 1 and about 20 moles ethylene oxide repeating units. The alkyl polyglucoside surfactant is preferably a $C_{6-24}$ alkyl polyglucoside surfactant having a degree of polymerization of between about 1 and about 10. In addition, the ratio of alcohol ethoxylate surfactant to alkyl polyglucoside surfactant is preferably provided between about 1:4 and about 4:1. Preferably, the weight ratio of alcohol ethoxylate surfactant to alkyl polyglucoside surfactant is between about 1:3 and about 3:1. The oil component of the microemulsion is preferably an oil which exhibits a water solubility at 22° C. of less than one percent by weight.

When the microemulsion detergent composition is provided as a concentrate, it preferably contains between about 30 wt. % and about 60 wt. % water, between about 1 wt. % and about 30 wt. % oil, and between about 20 wt. % and about 60 wt. % nonionic surfactant mixture. When the microemulsion detergent composition is provided as a use solution, the concentration of water can be adjusted depending upon the particular application for which the microemulsion is used. For example, when the microemulsion detergent composition is used as a hand soap, the use solution can contain between about 30 wt. % and about 99 wt. % water. When the microemulsion detergent composition is used as a pre-spotter, the use solution preferably includes between about 30 wt. % and about 60 wt. % water. When the microemulsion detergent composition is used as a parts washer or as an automobile cleaner, the use solution is preferably provided containing between about 90 wt. % and about 99.9 wt. % water.

The microemulsion detergent composition is preferably free of a surface active amount of surfactants containing at least one of the following groups: protonated amines, quaternary ammonium compounds, sulfanates, sulfates, ether sulfates, carboxylates, and phosphates. In addition, the microemulsion detergent composition can be provided so that it is substantially free of volatile organic compounds (VOC). In general, volatile organic compounds can include $C_{13}$ and lower compounds which can include certain hydrocarbons. Preferably, the microemulsion detergent composition provides a VOC level of less than about 300 ppm, more preferably less than about 100 ppm, and even more preferably less than about 10 ppm according to ASTM D 3960-87.

The microemulsion detergent composition can include a splitting agent for controlling the splitting properties of the microemulsion. The splitting agent may be useful for splitting the microemulsion in order to separate the soil from the surfactants. It may be desirable to periodically split a microemulsion use solution to remove soil and then allow the microemulsion to reform to provide a detersive use solution. For example, the splitting properties of the microemulsion can be controlled by altering the temperature of the microemulsion. A preferred splitting agent includes an amphoteric surfactant. The concentrate can include between about 1 wt. % and about 20 wt. % amphoteric surfactant to provide desired splitting properties.

The pH of the microemulsion detergent composition should be maintained at less than about 8 when an amphoteric surfactant is incorporated into the detergent composition. Preferably, the pH is selected to stay below the $pK_a$ of the amphoteric surfactant.

A method of removing hydrophobic soil from an article is provided by the invention. The method includes the step of contacting an article containing a hydrophobic soil with a microemulsion detergent composition. Exemplary articles which can be contacted with a microemulsion detergent composition include fabric, art surfaces, hands, and automobile exterior. The microemulsion detergent composition can preferably be used as a car wash composition. Accordingly, the microemulsion detergent composition can be provided as a use solution and sprayed on the exterior of a motor vehicle such as a car or truck. In addition, the microemulsion detergent composition can be used as a skin and/or hair cleaner.

DETAILED DISCUSSION OF THE INVENTION

The invention relates to microemulsion detergent compositions containing a mixture of nonionic surfactants, water, and oil. The microemulsion detergent composition can be referred to herein more simply as the microemulsion. The microemulsion can include a splitting agent for controlling the splitting properties of the microemulsion at a particular temperature. The microemulsion detergent composition can include additional components including antimicrobial agents, corrosion inhibitors, lubricants, brightening agents, antiredeposition agents, inorganic salts, dyes, fragrances, emollients, etc. The microemulsion is particularly formulated to enhance hydrophobic and oily soil removal in a variety of use applications.

The microemulsion can be provided so it is essentially free of ionic surfactants. Exemplary types of surfactants which can be excluded from the microemulsion of the invention include anionic surfactants, cationic surfactants, and amphoteric surfactants. Particular ionic surfactants which can be excluded from the microemulsion include surfactants containing at least one of the following groups: protonated amines; quaternary ammonium compounds; sulfonates; sulfates; ether sulfates; carboxylates; and phosphates. By providing that the microemulsion is substantially free of ionic surfactants or is substantially free of ionic surfactants having at least one of the above-identified ion groups, it is meant that the microemulsion contains less than 0.01 wt. % of an ionic surfactant. Although it is generally desirable to exclude ionic surfactants from the microemulsion, applicants discovered that amphoteric surfactants can provide particularly advantageous properties when used, for example, as splitting agents. Accordingly, the microemulsion can be characterized as excluding ionic surfactants other than amphoteric surfactants.

The microemulsion can be characterized in terms of clarity, dilutability, and microemulsion stability range (MSR). In general, the microemulsion according to the invention provides a clear composition which can be characterized by the general absence of haze, suspended solids and particulates, and other evidence of macroemulsion formation. In general, the clarity of the microemulsion is preferably close to the clarity of deionized water. When measured, using a Bausch & Lomb Spectrometer 20, the microemulsion, according to the invention, will preferably exhibit a transmission of visible light through a 1 cm cell of at least about 90% of the transmission observed for a 1 cm cell of deionized water under the same conditions. Under these test conditions, the microemulsion will more preferably exhibit at least about 95% transmission of visible light, and even more preferably exhibit at least about 98% transmission of visible light. Preferably, the percent transmission is equivalent to that of deionized water. It should be understood that the measurement of clarity of the microemulsion does not exclude the presence of color or color additives.

Dilutability refers to the characteristic of the microemulsion which allows it to accept water and maintain its clarity at a 1 wt. % dilution. That is, 1 wt. % of the microemulsion containing about the minimum amount of water needed for forming the microemulsion can be combined with 99 wt. % water and the resulting composition maintains the level of clarity discussed previously. The characteristic of dilutability is advantageous because it provides a microemulsion which can be diluted to provide a use solution which can be sprayed through a head without clogging the head. In general, the amount of water provided in a use solution depends on the particular application for which the use solution is to be used. For example, a hand soap use solution can be provided containing between about 30 wt. % and about 99 wt. % water, a pre-spotter use solution can be provided containing between about 30 wt. % and about 60 wt. % water, and a parts washer and automobile cleaner can be provided containing between about 90 wt. % and about 99.9 wt. % water.

The microemulsion stability range (MSR) refers to the temperature range in which the microemulsion remains a microemulsion. The MSR can be characterized numerically as the temperature range in which the composition remains a microemulsion at atmospheric pressure. The ends points of the MSR are determined by observation of phase separation. Phase separation can typically be detected by observing cloudiness, opacity, or separation into layers. In general, the end points of the MSR can be characterized by a lack of microemulsion stability. Under conditions of storage normally encountered in a warehouse, microemulsions having a narrow MSR will tend to phase separate when the temperature is too high or too low. While the composition may reform a microemulsion, it may become necessary to wait a fairly lengthy period of time in order for the microemulsion to reform before it can be used. It is generally undesirable to have to wait for a microemulsion to reform before using it in a cleaning operation. The microemulsion of the invention has a MSR which is greater than about 5° C. Preferably, the MSR is greater than about 10° C., and more preferably greater than about 15° C. Microemulsion according to the invention can be provided having a MSR greater than about 30° C.

Nonionic Surfactants

The invention relates to a microemulsion comprising a mixture of nonionic surfactants. The nonionic surfactants preferably include a first surfactant which is considered to be fairly water soluble and a second surfactant which is considered to be slightly soluble in both oil and water. The first surfactant preferably includes alcohol ethoxylate surfactants, and the second surfactant preferably includes alkyl polyglycoside surfactants.

Alcohol ethoxylate surfactants which can be used according to the invention preferably include $C_{6-24}$ alcohol ethoxylates having between about 1 and about 20 mole ethylene oxide repeating units, and more preferably a $C_{9-15}$ alcohol ethoxylate having between about 3 and about 9 moles ethylene oxide repeating units. The alkyl group can include a straight chain or branched chain. A preferred alcohol ethoxylate is a $C_{12-15}$ alcohol ethoxylate having between about 4 and about 6 ethylene oxide repeating units. Preferred alcohol ethoxylates which can be used according to the invention are available under the name Surfonic L24-5 from Huntsman Chemical.

Alkyl polyglycoside surfactants which can be used according to the invention preferably include a $C_{6-24}$ alkyl group and a degree of polymerization of between about 1 and about 20. Preferably, the alkyl polyglycoside surfactants have a $C_{8-14}$ alkyl group and a degree of polymerization of between 1.1 and about 5. A preferred alkyl polyglycoside surfactant which can be used according to the invention is available under the name Glucopon 625 from Henkel.

It should be understood that the alcohol ethoxylate surfactant component of the microemulsion can be provided as a single alcohol ethoxylate or as a mixture of alcohol ethoxylates. Similarly, the alkyl polyglycoside surfactant component of the microemulsion can be provided as a single alkyl polyglycoside or as a mixture of alkyl polyglycosides.

The alcohol ethoxylate surfactant and the alkyl polyglycoside surfactant are provided at a weight ratio which is sufficient to provide a microemulsion when combined with water and oil. Preferably, the weight ratio of alcohol ethoxylate surfactant to alkyl polyglycoside surfactant is between about 1:4 and about 4:1. Preferably, the weight ratio of alcohol ethoxylate surfactant to alkyl polyglycoside surfactant is between about 1:3 and about 3:1, and more preferably between about 1:2 and about 2:1. Applicants have found that a preferred weight ratio is about 1:1.

The microemulsion preferably includes a mixture of nonionic surfactants in an amount that provides a microemulsion concentrate and which can be diluted to maintain a microemulsion use solution. Preferably, the concentrate includes between about 20 wt. % and about 60 wt. % nonionic surfactant mixture. More preferably, the concentrate includes between about 25 wt. % and 35 wt. %, and even more preferably between about 30 wt. % and about 50 wt. % of the nonionic surfactant mixture.

Water

The microemulsion concentrate preferably includes at least a sufficient amount of water to provide microemulsion properties within the desired microemulsion stability range. Preferably, the microemulsion contains at least about 30 wt. % water. In general, the microemulsion according to the invention remains a microemulsion as it becomes diluted with water. That is, the microemulsion can be made available as a concentrate, and later diluted with water by the user to provide a use solution. Accordingly, it is expected that the use solution may contain up to about 99 wt. % water. The microemulsion concentrate preferably contains between about 30 wt. % and about 60 wt. % water.

Oil

The oil component which is incorporated into the microemulsion concentrate is one which exhibits a water solubility at 22° C. of less than 1 wt. %. The oil component of the microemulsion helps form the microemulsion and at the same time, tends to act as a solvent or softener for the hydrophobic soil. Exemplary types of oils which can be used in forming the microemulsion of the invention include mineral oil, mineral spirits, pine oil, fatty esters, carboxylic diester oils, motor oils, triglycerides, and the like.

The microemulsion concentrate preferably includes at least a sufficient amount of oil to provide microemulsion properties within the desired microemulsion stability range. Preferably, the oil component is provided in the microemulsion concentrate in a range of between about 1 wt. % and about 30 wt. %. It should be appreciated that the microemulsion is provided for removing hydrophobic soils, such as oily substances, from an article. Accordingly, as hydrophobic soil is removed, the oil component of the microemulsion increases.

The microemulsion can be provided for removing hydrophobic and particulate soil from an article. It should be understood that hydrophobic and particulate soils refer to oily or greasy soils containing particulate matter. In general, this type of soil can often be characterized by a caked appearance. As the hydrophobic and particulate soil is removed, the oily component of the hydrophobic and particulate soil can become a part of the oil component of the microemulsion. Exemplary hydrophobic soils include hydrocarbons, tar, bitumens, asphalts, etc. Exemplary particulates which can be found in the hydrophobic soil include mineral clays, sand, dirt, clays, natural mineral matter, carbon black, graphite, graphitic materials, caolin, environmental dust, etc. In general, soils which are of particular concern include clean an dirty motor oils, asphaltenes, hydrocarbons, coal tars, petroleum greases, fatty body soils, transmission fluids, hydraulic oils and greases, and the like. These soils are typical of the soils often found in truck or auto repair shops, gasoline and/or filling stations, industrial maintenance shops, petroleum refining and processing plants, machine repair shops, and food preparation facilities, and are fairly resistant to removal by washing with conventional detergents. Exemplary articles which can be subjected to cleaning for the removal of these soils include worker's clothing, machine parts, grill parts and oil pans. The soil found on these articles is often characterized by a caked on appearance. In addition, animal skin, such as human skin, hair, and nail tissue are often contaminated with the soils, and are difficult to clean with conventional detergents. An exemplary technique for cleaning hard surfaces, such as engine parts, includes recirculating a microemulsion use solution in a bath and introducing the hard surfaces to be cleaned into the bath.

The microemulsion can additionally be used for cleaning hard surfaces, textiles, skin, and hair which may or may not contain the above-described hydrophobic and particulate soils. For example, the microemulsion can be provided as a use solution and used to clean automobiles and trucks in a car wash.

Splitting Agent

A splitting agent can be incorporated into the microemulsion for controlling the splitting property of the microemulsion. That is, by adding the splitting agent, the microemulsion can be provided so that at a desired temperature, the microemulsion splits thereby allowing separation and removal of the oil component. It is believed that this controlled splitting property is desirable in many applications including, in particular, the use of the microemulsion as a hard surfaces parts cleaner and as a laundry detergent. In the case of a hard surfaces part cleaner, an aqueous solution containing the microemulsion can be circulated for cleaning hydrophobic soil off hard surfaces such as motor engine parts. Once the recirculated use solution becomes saturated with hydrophobic soil, the temperature of the use solution can be changed resulting in a splitting off of the oil component. The oil component can then be isolated and discarded, and the microemulsion can be reformed according to the invention.

The splitting agent is preferably an amphoteric surfactant and is preferably provided in the microemulsion concentrate at a concentration of between about 1 wt. % to about 20 wt. %. Preferably, the splitting agent is provided at a level of between about 2 wt. % and about 10 wt. %, and more preferably between about 3 wt. % and about 7 wt. %.

It should be appreciated that the discussion of surfactants in this application refers to 100% active surfactant compositions. Of course, certain manufacturers make surfactants available at a particular active level. These types of surfactants can be used according to the invention, but the calculation of the amount of surfactant is based upon a 100% active level.

Various amphoteric surfactants can be used according to the invention. Preferred amphoteric surfactants include those compounds having formulas I–III below.

(I)

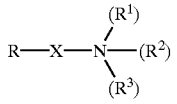

wherein

X is a linear or branched alkylene, hydroxyalkylene or alkoxyalkylene group having 1–4 carbon atoms;

R is $R^4$—CO—NH or $R^4$ in which $R^4$ is a saturated or unsaturated, branched or linear alkyl group having 4–22 carbon atoms;

$R^1$ is hydrogen, A or $(A)_n$—X—$CO_2^-Z^+$ in which A is a linear or branched alkyl, hydroxyalkyl or alkoxyalkyl having 1–4 carbon atoms, n is an integer from 0 to 6, and Z is an alkali metal cation, a hydrogen ion or an ammonium cation;

$R^2$ is $(A)_n$—X—$CO_2^-Z^+$; and $R^3$ is absent or A.

(II)

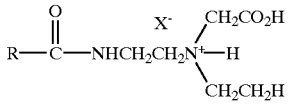

wherein:

R is hydrogen, straight or branched alkyl having 1 to 16 carbon atoms, in which the alkyl group is uninterrupted or interrupted by phenyl, and X is an anion.

The amphoteric surfactant can be an amphoteric dicarboxylate. The amphoteric dicarboxylate is a compound having the following formula:

(III)

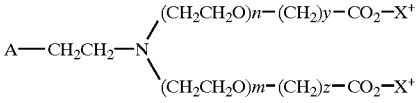

wherein A is R, or

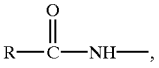

R is $C_{6-17}$ alkyl, y and z are independently selected from the group consisting of 1–6 and m and n are independently selected from the group consisting of 0–6, m+n≧1. The $X^+$ substituent represents a proton, an alkali metal cation or a portion of an alkaline earth metal cation. Preferred materials for use in this invention are the amphoteric dicarboxylate materials, disodium cocoamphodiacetate, disodium cocoamphodipropionate, disodium cocoaminodipropionate or mixtures thereof. These materials are available from Mona Industries, Inc., Patterson, N. J. and Rhone-Poulenc, Inc.

The amphoteric dicarboxylate can be added in a single portion, can be divided into several portions separately added or can be continuously metered into the aqueous stream. Typically the amphoteric material is added prior to the addition of a cationic destabilizer or flocculent and prior to any pH change or separation initiation. One preferred mode of utilizing the amphoteric dicarboxylate material in separating hydrophobic soils from an aqueous stream involves using a detergent composition formulated with the amphoteric dicarboxylate material. Such aqueous detergents can be used in a variety of cleaning protocols including laundry, floor cleaning, equipment cleaning, etc. The detergent composition contains a fully formulated built system using the amphoteric dicarboxylate as a component of the detergent. The detergent composition can contain a variety of other ingredients including both organic and inorganic functional materials, builders, etc.

When an amphoteric surfactant is incorporated into the microemulsion, the pH of the microemulsion is preferably provided at less than about 8. More preferably, the pH is below about 7, and even more preferably below about 5. Preferably, the pH of the microemulsion is controlled to less than the $pK_a$ of the amphoteric surfactant.

Additional Components

In addition to those components previously described, other conventional detergent components can be incorporated into the microemulsion. Such components may include such compounds as bactericides, brightening agents, antiredeposition agents, emollients, inorganic salts, dyes, fragrances, and corrosion inhibitors. Preferred bactericides include antimicrobial agents and oxidative antimicrobial agents. Exemplary oxidative antimicrobials include hydrogen peroxide, peracids, ozone, hypochloride, and chlorine dioxide. Components which interfere with the cleaning properties of the microemulsion can be excluded.

The microemulsion according to the invention can be made available as a cleaning composition and is provided so that the microemulsion is maintained under certain conditions, and the microemulsion can be selectively destroyed causing a split between the oil-soluble components and the water-soluble components. During washing, it is desirable for the cleaning composition to remain a microemulsion in order to facilitate removal of soil from an article. Once the soil has been removed from the article, the microemulsion can be selectively destroyed causing the oil-soluble components to split from the water-soluble components. The oil-soluble components, which includes the soil, can then be separated.

The microemulsion can be maintained as a microemulsion by controlling: (1) the pH of the composition; (2) the ratio of amphoteric surfactant to other surfactants; and (3) the ratio of surfactants to oil.

The pH of the cleaning composition should be maintained at less than about 8. Preferably, the pH is less than about 7, and greater than about 4. A preferred pH range is between about 5 and about 6. In general, the pH is selected to stay below the $pK_a$ of the amphoteric surfactant, if one is included in the composition.

The surfactants which can be included in the microemulsion can be referred to as a first surfactant and a second surfactant, as discussed above, and an amphoteric surfactant. The first surfactant is preferably one which is considered to be fairly water soluble, the second surfactant is preferably one which is considered to be slightly soluble in water and oil, and the aniphoteric surfactant is preferably considered to be one which is water soluble and oil insoluble. The first surfactant is preferably an alcohol ethoxylate surfactant, and the second surfactant is preferably an alkyl polyglucoside surfactant.

The surfactant component of the microemulsion preferably includes a greater amount of alkyl polyglycoside surfactant than amphoteric surfactant, and a greater amount of alcohol ethoxylate surfactant than alkyl polyglycoside surfactant. A preferred surfactant composition includes between about 40% wt. % and about 60 wt. % alcohol ethoxylate surfactant, between about 15% wt. % and about 35% wt. % alkyl polyglycoside surfactant, and between about 2% wt. % and about 15% wt. % amphoteric surfactant. A more preferred surfactant composition includes between about 45% wt. % and about 55 wt. % alcohol ethoxylate surfactant, between about 20% wt. % and about 30% wt. % alkyl polyglycoside surfactant, and between about 3% wt. % and about 7% wt. % amphoteric surfactant.

The microemulsion is provided by controlling the ratio of surfactant composition to oil component. In general, it is desirable to provide a ratio of surfactant composition to oil of between about 3.5 parts surfactant composition and 0.5 parts oil to about 3.5 parts surfactant composition and about 1.5 parts oil. Preferably, the ratio of surfactant composition to oil is about 3.5 parts surfactant composition to about 1 part oil.

The microemulsion can be used in several applications as a cleaning composition. For example, the microemulsion can be provided as a use solution and used as a parts washer where it is provided in a recirculating bath where parts in need of cleaning are introduced into bath and removed therefrom after cleaning. The microemulsion detergent composition can be used as a motor vehicle washing composition where it is sprayed on the exterior of a motor vehicle and then rinsed from the motor vehicle. In this situation, the microemulsion composition can be referred to as a car wash composition. In addition, the microemulsion detergent composition can be used for washing textiles in conventional textile washing machinery.

When the microemulsion detergent composition is used as a motor vehicle washing composition, it is desirable to provide as the oil component of the microemulsion, an oil that will evaporate from the vehicle surface. It is generally undesirable to use an oil that will leave a thin layer of oil on the vehicle surface. More preferably, the oil component of the microemulsion should be one which allows water to bead up into small droplets on the surface of the vehicle. The oil component is preferably one which provides a desired shedding and drying effect. An exemplary oil which can be used in the microemulsion composition used for providing a motor vehicle washing composition is mineral spirits.

The invention additionally relates to a method for phase inverting a microemulsion use solution according to the invention. By altering the temperature of the use solution, it is possible to cause a split between oil and water phases. The oil phase can then be removed and the surfactants can be used to reform a microemulsion detergent composition according to the invention.

EXAMPLE 1

Microemulsion Compositions

This example identifies the formulation of several microemulsion compositions, their dilution capability, and their useful microemulsion stability range (MSR). The data provided in Tables 1 and 2 include preferred formulation guidelines for the components identified. The ranges include about 40 wt. % to about 60 wt. % water, about 15 wt. % to about 35 wt. % of an ethoxylate nonionic surfactant, about 9 to about 24 wt. % alkyl polyglycoside surfactant, and about 10 to about 25 wt. % hydrophobic solvent. Preferred ranges include about 45 wt. % to about 55 wt. % water, about 15 wt. % to about ethoxylated nonionic surfactant, 20 wt. % alkyl polyglycoside, and the remainder as hydrophobic solvent. Generally it is found that having a total nonionic surfactant (ethoxylate plus polyglycoside) to hydrophobic oil (e.g., mineral oil) ratio of greater than 1.4 provides a microemulsion exhibiting desirable characteristics.

The microemulsion stability range (MSR) for each composition is shown, and indicates the possibility to formulate a clear microemulsion liquid, gel, or solid composition that will yield maximum detergency performance over a range of temperatures; i.e., cleaning capacity generally is increased within or near the MSR. Sample Nos. 1-7 to 1-18 show clear flowing microemulsion compositions within various temperature ranges; e.g., 0–40° C., 40–70° C., and 70–95+° C. The data also shows the relatively wide MSR (e.g., >30° C.) possible for formulations of the invention. Conversely, sample Nos. 1-1 to 1-5 form a dispersible milky emulsion (do not yield a clear microemulsion) and are not found to yield a definite MSR.

Also important attribute for any microemulsion composition is that they might allow dilution by an aqueous phase for washing purposes to yield clear solutions. Typically 0.1 and 1 wt. % dilutions of the concentrate are utilized to determine the robustness of the system. The example shows the 1% clarity data with all the microemulsion examples yielding a clear dilution. On the contrary, all of the emulsion examples yield cloudy to milky dilute solutions. The "near" microemulsion of sample No. 1-6 gives a cloudy appearance, and not the clear microemulsion look.

The amount of components reported in Table 1 are provided in weight percent.

TABLE 1

Microemulsion Compositions

| Sample No. | Water | alcohol 5-EO[1] | poly-glycoside[2] | hydrophobic oil (mineral oil) | total nonionic-to-hydrophobic oil ratio[3] | Room Temperature (RT) Composition Descriptive | clear liquid MSR range (° C.)[4] | 1% solution clarity (RT)[5] |
|---|---|---|---|---|---|---|---|---|
| Emulsion | | | | | | | | |
| 1-1 | 52.3 | 15.3 | 15.3 | 17.1 | 1.3 | milky emulsion | 46–80° | milky |
| 1-2 | 55.6 | 10.2 | 10.2 | 24.0 | 0.6 | milky emulsion | none | milky |
| 1-3 | 64.0 | 5.0 | 5.0 | 26.0 | 0.3 | milky emulsion | none | milky |
| 1-4 | 68.1 | 7.4 | 7.4 | 17.1 | 0.6 | milky emulsion | none | milky |
| 1-5 | 74.0 | 8.0 | 8.0 | 10.0 | 1.2 | opaque emulsion | none | milky |

TABLE 1-continued

| Microemulsion Compositions | | | | | | | | |
|---|---|---|---|---|---|---|---|---|
| Sample No. | Water | alcohol 5-EO[1] | poly-glycoside[2] | hydrophobic oil (mineral oil) | total nonionic-to-hydrophobic oil ratio[3] | Room Temperature (RT) Composition Descriptive | clear liquid MSR range (° C.)[4] | 1% solution clarity (RT)[5] |
| Near Microemulsion | | | | | | | | |
| 1-6 | 52.3 | 25.5 | 10.2 | 12.0 | 2.6 | thick opaque emulsion | 46–80° | cloudy |
| Microemulsion | | | | | | | | |
| 1-7 | 44.2 | 25.4 | 10.2 | 20.2 | 1.5 | clear gel | 67–95° | clear |
| 1-8 | 47.2 | 20.4 | 20.4 | 12.0 | 2.6 | thin clear liquid | 5–46° | clear |
| 1-9 | 47.2 | 30.6 | 10.2 | 12.0 | 3.0 | clear solid | 55–95° | clear |
| 1-10 | 47.2 | 35.8 | 5.0 | 12.0 | 3.2 | clear gel | 65–95° | clear |
| 1-11 | 47.2 | 25.5 | 10.2 | 17.1 | 1.8 | clear solid | 53–69° | clear |
| 1-12 | 47.2 | 22.9 | 15.3 | 14.6 | 2.1 | thin clear liquid | 5–20° | clear |
| 1-13 | 49.2 | 26.9 | 10.2 | 13.7 | 2.3 | thick clear liquid | 67–95° | clear |
| 1-14 | 49.7 | 23.0 | 15.3 | 12.0 | 2.6 | thin clear liquid | 10–33° | clear |
| 1-15 | 49.7 | 20.4 | 15.3 | 14.6 | 1.9 | thin clear liquid | 0–39° | clear |
| 1-16 | 52.3 | 20.4 | 10.2 | 17.1 | 1.5 | thick clear liquid | 27–46° | clear |
| 1-17 | 52.3 | 20.4 | 15.3 | 12.0 | 2.3 | thin clear liquid | 0–39° | clear |
| 1-18 | 57.4 | 20.4 | 10.2 | 12.0 | 2.1 | thin clear liquid | 5–33° | clear |
| use range | 40–60% | 15–30% | 9–24% | 10–25% | | | | |

[1]Alcohol 5-EO is a 5-mole alcohol ethoxylate nonionic surfactant available under the name Surfonic L24-5 from Huntsman Chemical.
[2]Polyglycoside is an alkylated polyglycoside nonionic surfactant available under the name Glucopon 625 from Henkel.
[3]A ratio of (alcohol 5-EO + polyglycoside)/hydrophobic oil
[4]MSR (microemulsion stability range)
[5]1% solution clarity (RT) is at room temperature.

EXAMPLE 2

Microemulsion Compositions with Builders

Various microemulsion compositions were prepared including a commercial builder (organic and inorganic chelants and alkalinity sources) system in the water phase and hexadecane as a hydrophobic solvent. Preferred microemulsion compositions include about 50 wt. % aqueous builder, 20 wt. % ethoxylated nonionic surfactant, 20 wt. % alkyl glycoside surfactant, and the remainder hydrophobic solvent.

Also, as shown in Table 1, there is a correlation between the concentrate clarity and the use solution clarity; with a variety of microemulsion stability ranges (MSR) available.

TABLE 2

| Microemulsion Compositions with Organic and Inorganic Additives via a Commercial Builder | | | | | | | |
|---|---|---|---|---|---|---|---|
| Sample No. | Aqueous Phase (2000 ppm builder)[1] | alcohol 5-EO[2] | poly-glycoside[3] | hexadecane | Room Temperature (RT) Composition Descriptive | clear liquid MSR (° C.)[4] | 1% solution clarity (RT) |
| Prior Art | | | | | | | |
| 2-1 | 13.0 | 6.0 | 6.0 | 75.0 | milky emulsion | none | milky |
| 2-2 | 13.0 | 6.0 | 6.0 | 75.0 | milky emulsion | none | milky |
| 2-3 | 42.7 | 21.4 | 21.4 | 14.5 | thick opaque gel | none | cloudy |
| 2-4 | 52.2 | 11.2 | 11.2 | 25.4 | thick milky emulsion | none | milky |
| 2-5 | 68.6 | 7.4 | 7.4 | 16.6 | milky emulsion | 80–95° | milky |
| 2-6 | 74.9 | 8.0 | 8.0 | 9.1 | translucent liquid | none | cloudy |
| Current Invention | | | | | | | |
| 2-7 | 42.7 | 18.3 | 18.3 | 20.7 | thin clear liquid | 0–50° | clear |
| 2-8 | 47.6 | 20.4 | 20.4 | 11.6 | thin clear liquid | 0–60° | clear |
| 2-9 | 59.8 | 12.8 | 12.8 | 14.6 | thin clear liquid | <20–55° | clear |
| 2-10 | 64.5 | 13.8 | 13.8 | 7.9 | thin clear liquid | 65–95° | clear |

I. 2000 ppm active Turbo Speed; a commercial silicated laundry builder system from Ecolab Inc.; St. Paul, MN.

II. Alcohol 5-EO is a 5-mole alcohol ethoxylate nonionic surfactant available under the name Surfonic L24-5 from Huntsman Chemical.

III. Polyglycoside is an alkylated polyglycoside nonionic surfactant available under the name Glucopon 625 from Henkel.

IV. MSR (microemulsion stability range) is the temperature window when a clear single-phase flowable liquid exists.

EXAMPLE 3

Other Hydrophobic Phases

Various microemulsion compositions were prepared incorporating various hydrophobic components. The microemulsion compositions are reported in Table 3. The amounts of the components are reported in weight percent.

TABLE 3

Microemulsion Compositions with Various Oil Types

| Sample No. | Oil Type | alcohol 5-EO[1] | poly-glycoside[2] | Total Oil | Aqueous Phase (2000 ppm builder)[3] | comments | clear liquid MSR (° C.)[4] |
|---|---|---|---|---|---|---|---|
| 3-1 | hexadecane | 20.4 | 20.4 | 12.0 | remainder | clear thin liquid | 5–65° |
| 3-2 | mineral oil | 20.4 | 20.4 | 12.0 | remainder | clear thin liquid | 0–46° |
| 3-3 | methyl soyate/hexadecane | 20.4 | 20.4 | 12.0 | remainder | clear thick liquid | 5–46° |
| 3-4 | dipentene | 20.4 | 20.4 | 12.0 | remainder | clear thin liquid | 29–41° |
| 3-5 | di-butyl dodecanoate | 20.4 | 20.4 | 12.0 | remainder | clear thin liquid | 5–62° |

[1]Alcohol 5-EO is a 5-mole alcohol ethoxylate nonionic surfactant available under the name Surfonic L24-5 from Huntsman Chemical.
[2]Polyglycoside is an alkylated polyglycoside nonionic surfactant available under the name Glucopon 625 from Henkel.
[3]2000 ppm active Turbo Speed; a commercial silicated laundry builder system from Ecolab Inc.; St. Paul, MN.
[4]MSR (emulsion stability range) is the temperature window when a clear single-phase flowable liquid exists.

EXAMPLE 4

Textile Washing with Microemulsions

This example demonstrates the utility of the microemulsion composition as a laundry detergent. A conventional laundry wash process was used to compare the current invention microemulsions with a standard commercial detergent. The composition and test results are reported in Table 4.

A 35 lb. washer was filled with 20 lbs. of fill fabric, 11 gallons of water at the appropriate temperature (column 5), the commercial detergents (column 2), and a series of commercial dirty motor oil (DMO) standard test swatches (6 duplicates per test). The detergent booster (column 3) was added to the washer at various levels (column 4) and the cleaning cycle was run for 10 minutes, followed by a water dump, and then a 5 minute rinse. The swatches were evaluated by reflectance measurements using a Hunter Ultrascan Sphere Spectrocolorimeter (Hunter Lab). Reflectance is a numerical representation of the fraction of the incident light that is reflected by the surface. Cleanliness of the surface is related to an increase in the L-value (a measurement of the lightness that varies from 100 for perfect white to 0 for black, approximately as the eye would evaluate it) and the whiteness index (WI) (a measure of the degree of departure of an object from a 'perfect' white). Both values have been found as very reproducible, and numerically representative of the results from visual inspection. It is shown that effective and complete cleaning will return the L and WI values to those at, or above, the new fabric values. Lack of cleaning, or removal to intermediate levels, gave no, to intermediate, increases in the reflectance values, respectfully.

The results reported in column 7 of Table 4 contrast the detergency results of the microemulsion of the invention with those of a commercial solvent based detergent booster. As shown, comparable soil removal results can be achieved using the claimed microemulsions as a heavy-soil detergent booster compared with the use of a solvent based detergent booster A 30° F. reduction in wash temperature is realized by the invention to achieve the same results (see column 6). Also, as shown in column 4, the microemulsion of the invention can be made without VOC (volatile organic compounds) restrictions; a significant impact on flammability and health concerns.

The results also demonstrate the ability of the invention to additionally improve detergency by using more additive or by changing the microemulsion composition. Thus, even with lower wash temperatures, a increase in detergency of 10% can be realized over the prior art.

TABLE 4

Textile Washing With Microemulsion Compositions

| Sample No. | Base Detergents[1] (grams) | Detergent Booster[2] | VOC[7] | Booster Amount (grams) | Wash Temperature (° F.) | Soil Removal (%)[3] |
|---|---|---|---|---|---|---|
| 4-1 | Turbo Speed (180 grams) | commercial TCD ILF-15 | >60% | 100 grams | 150° F. | 33 |
| 4-2 | Ecolab 2002 (100 grams) Turbo Charge (50 grams) | commercial TCD ILF-15 | >60% | 400 grams | 150° F. | 33 |
| 4-3 | Turbo Speed (180 grams) | Microemulsion A[4] | 0% | 100 grams | 120° F. | 35 |
| 4-4 | Ecolab 2002 (100 grams) Turbo Charge (50 grams) | Microemulsion A[4] | 0% | 400 grams | 120° F. | 37 |
| 4-5 | Turbo Speed (180 grams) | Microemulsion B[5] | 0% | 100 grams | 120° F. | 32 |
| 4-6 | Ecolab 2002 (100 grams) Turbo Charge (50 grams) | Microemulsion B[5] | 0% | 400 grams | 120° F. | 36 |
| 4-7 | Turbo Speed (180 grams) | Microemulsion C[6] | 0% | 100 grams | 120° F. | 33 |
| 4-8 | Ecolab 2002 (100 grams) Turbo Charge (50 grams) | Microemulsion C[6] | 0% | 400 grams | 120° F. | 43 |

TABLE 4-continued

Textile Washing With Microemulsion Compositions

| Sample No. | Base Detergents[1] (grams) | Detergent Booster[2] | VOC[7] | Booster Amount (grams) | Wash Temperature (° F.) | Soil Removal (%)[3] |
|---|---|---|---|---|---|---|

[1]Turbo Speed is a commercial silicated laundry builder system, Turbo Charge is a commercial surfactant system, and Ecolab 2002 is a developmental surfactant additive; all from Ecolab Inc.; St. Paul, MN.
[2]The detergent booster is either TCD ILF-15, a heavy soil detergent additive from Ecolab Inc.; St. Paul, MN, or one of the test microemulsions.
[3]Soil removal is measured by an increase in the lightness (L) value.
[4]Microemulsion A is a formula having: 20.4% alcohol 5-EO ethoxylate, 20.4% alkyl glycoside, 12% mineral oil, and the remainder as water.
[5]Microemulsion B is a formula having: 30.6% alcohol 5-EO ethoxylate, 10.2% alkyl glycoside, 12% mineral oil, and the remainder as water.
[6]Microemulsion C is a formula having: 35.8% alcohol 5-EO ethoxylate, 5.0% alkyl glycoside, 12% mineral oil, and the remainder as water.
[7]VOC refers to volatile organic compounds.
[8]Alcohol 5-EO is a 5-mole alcohol ethoxylate nonionic surfactant available under the name Surfonic L24-5 from Huntsman Chemical.
[9]Polyglycoside is an alkylated polyglycoside nonionic surfactant available under the name Glucopon 625 from Henkel.

EXAMPLE 5

Hard Surface Cleaning with Microemulsions

Detergent compositions were used for cleaning hard surfaces and industrial parts. The results are reported in Table 5. Used automotive oil pans with extensive soil layers were cut into 2"×4" coupons and soaked—with agitation—in the solution (25 wt. % microemulsion or cleaner in water) at 120° F. for 15 minutes, followed by 60 minutes of room temperature soaking. The coupons were removed from the test solution, rinsed, and given a visual soil removal evaluation on a scale from 1 (poor) to 5 (excellent/complete).

As shown, the microemulsion compositions using relatively innocuous ingredients work as effectively as the prior art, but without the use of deleterious high-VOC solvents; i.e., the soil removing detergency results are near those found for the volatile solvent formulae (cf., lines 1–2 vs. 3–9). Also, the microemulsion compositions according to the invention exhibit no offensive odors from mineral spirits or glycols.

This example demonstrates the positive effect that a branched alkyl-hydroxy-amine can have on the soil removal performance (compare sampled numbers 5-3 with 5-5 and 58). This enhancement appears to have maxima as shown when comparing lines 4–6 and 7–9. The necessity of alkyl branching in the adjuvant is demonstrated by comparing sample numbers 5-5 and 5-8 with 5-10 and 5-11.

TABLE 5

Microemulsion Cleaning Adjuvants

| Sample No. | Detergent | VOC CONTENT[1] | Industrial Parts Cleaning (Soil Removal)[2] (1 = poor) to (5 = excellent/complete)[2] |
|---|---|---|---|
| 5-1 | Textile Care ILF-15[3] | >60% | 4.25 Good–Excellent |
| 5-2 | Buckeye XL-100 Heavy Duty Cleaner Degreaser[4] | <15% | 3.0 Fair |
| 5-3 | Microemulsion A[5] | 0% | 3.75 Fair–Good |
| 5-4 | Microemulsion A + 6 wt. % 2-amino-2-methyl-1-propanol | 0% | 4.0 Good |

TABLE 5-continued

Microemulsion Cleaning Adjuvants

| Sample No. | Detergent | VOC CONTENT[1] | Industrial Parts Cleaning (Soil Removal)[2] (1 = poor) to (5 = excellent/complete)[2] |
|---|---|---|---|
| 5-5 | Microemulsion A + 9 wt. % 2-amino-2-methyl-1-propanol | 0% | 4.25 Good–Excellent |
| 5-6 | Microemulsion A + 12 wt. % 2-amino-2-methyl-1-propanol | 0% | 3.75 Fair–Good |
| 5-7 | Microemulsion A + 0.5 wt. % monoisopropanolamine | 0% | 1.0 Very Poor |
| 5-8 | Microemulsion A + 6 wt. % monoisopropanolamine | 0% | 4.0 Fair–Good |
| 5-9 | Microemulsion A + 9 wt. % monoisopropanolamine | 0% | 3.0 Fair |
| 5-10 | Microemulsion 5-1 + 6 wt. % diethanolamine | 0% | 1.0 Very Poor |
| 5-11 | Microemulsion 5-1 + 6 wt. % triethanolamine | 0% | 1.0 Very Poor |

[1]VOC refers to volatile organic compounds.
[2]Soil Removal visual ratings based on cleanliness after wash time. Excellent (5) = >90% clean, good (4) = >80% clean, Fair (3) = >70% clean, Poor (1–2) = <60% clean.
[3]Textile Care ILF-15 is a commercial dirty motor oil cleaning product containing complex blends of ethoxylates of >2-EO units and hydrocarbon solvents; from Ecolab Inc., St. Paul, MN.
[4]Buckeye XL-100; Buckeye International, Inc.; Maryland Heights, MO.
[5]Microemulsion A is a formula having: 20.4% alcohol 5-EO ethoxylate, 20.4% alkyl glycoside, 12% mineral oil, and the remainder as water.
[6]Alcohol 5-EO is a 5-mole alcohol ethoxylate nonionic surfactant available under the name Surfonic L24-5 from Huntsman Chemical.
[7]Polyglycoside is an alkylated polyglycoside nonionic surfactant available under the name Glucopon 625 from Henkel.

EXAMPLE 6

Industrial Parts Cleaning with Microemulsions

Detergent compositions were used for industrial parts washing. The results are reported in Table 6. Soiled automotive oil pan parts were washed in a commercial wash system. The parts were scrubbed 5 times over 15 seconds of wash time, rinsed, and given a visual soil removal evaluation on a scale from 1 (poor) to 5 (excellent/complete).

The microemulsion compositions using relatively innocuous ingredients work as effectively as the prior art, but without the use of deleterious, possibly flammable, high-VOC solvents; i.e., the detergency results are identical-or-better than those found for the solvent formulae (cf., lines 1–2 vs. 3–4). Also, the current art microemulsion compositions have no offensive odors from mineral spirits or glycols.

TABLE 6

Industrial Dirty Parts Cleaning From Automotive Surfaces

| Sample No. | Detergent | Flash Point | VOC's[1] | Industrial Parts Cleaning (Soil Removal)[2] (1 = poor) to (5 = excellent/complete)[2] |
|---|---|---|---|---|
| 6-1 | Textile Care ILF-15[3] | <140 ° F. | >60% | 4.5 Good–Excellent (<20 seconds cleaning time) |
| 6-2 | Buckeye XL-100 Heavy Duty Cleaner Degreaser[4] | >180 ° F. | <15% | 3.5 Fair–Good (40–80 seconds cleaning time) |
| 6-3 | Microemulsion A[5] (formula = Table 1, line 8) | >180 ° F. | 0% | 4.5 Good–Excellent (<20 seconds cleaning time) |
| 6-4 | Microemulsion A + 6 wt. % 2-amino-2-methyl-1-propanol | >180 ° F. | 0% | 4.5 Good–Excellent (<20 seconds cleaning time) |

[1]VOC refers to volatile organic compounds.
[2]Soil Removal visual ratings based on cleanliness after 5 brush strokes over a 15 second wash time. Excellent (5) = >90% clean, good (4) = >80% clean, Fair (3) = >70% clean, Poor (1–2) = <60% clean.
[3]Textile Care ILF-15 is a commercial dirty motor oil cleaning product containing complex blends of ethoxylates of >2-EO units and hydrocarbon solvents; from Ecolab Inc., St. Paul, MN.
[4]Buckeye XL-100; Buckeye Internatinal, Inc.; Maryland Heights, MO.
[5]Microemulsion 6-1 is a formula having: 20.4% alcohol 5-EO ethoxylate, 20.4% alkyl glycoside, 12% mineral oil, and the remainder as water.
[6]Alcohol 5-EO is a 5-mole alcohol ethoxylate nonionic surfactant available under the name Surfonic L24-5 from Huntsman Chemical.
[7]Polyglycoside is an alkylated polyglycoside nonionic surfactant available under the name Glucopon 625 from Henkel.

EXAMPLE 7

Ink Removal with Microemulsions

Detergent compositions were used for ink removal. The results are reported in Table 7. Soiled printing press towels from an industrial laundry were pre-soaked in a variety of formulas, followed by washing in commercial wash program (as in example 4). Ink removal was determined by visual examination.

The microemulsion compositions, while at lower total organic activity concentrations, greatly outperformed the commercial 100% concentrated oils as ink soil pre-spotting aides.

TABLE 7

Ink removal

| Detergent | Formula Activity[1] (wt. % organics) | Ink Removal (%)[2] |
|---|---|---|
| 7-1 Di-butyl dodecanoate | 100% | <10% |
| 7-2 Methyl soyate | 100% | <10% |
| 7-3 Microemulsion D[3] | 25% | >70% |
| 7-4 Microemulsion E[4] | 25% | >70% |

[1]Activity is based on the total organics.
[2]Visual determination versus the untreated control towels.
[3]Microemulsion D includes: 20.4% alcohol 5-EO ethoxylate, 20.4% alkyl glycoside, 12% di-butyl dodecanoate, and the remainder as water; then diluted to be 25 wt. % active in total organics.

TABLE 7-continued

Ink removal

| Detergent | Formula Activity[1] (wt. % organics) | Ink Removal (%)[2] |
|---|---|---|

[4]Microemulsion E includes: 20.4% alcohol 5-EO ethoxylate, 20.4% alkyl glycoside, 12% methyl soyate, and the remainder as water; then diluted to be 25 wt. % active in total organics.
[5]Alcohol 5-EO is a 5-mole alcohol ethoxylate nonionic surfactant available under the name Surfonic L24-5 from Huntsman Chemical.
[6]Polyglycoside alkylated polyglycoside nonionic surfactant available under the name Glucopon 625 from Henkel.

EXAMPLE 8

Two microemulsion compositions were prepared as reported in Table 1.

TABLE 8

Microemulsion Compositions

| Components | Composition F | Composition G |
|---|---|---|
| Mineral Spirits | 12.0 | 12.0 |
| Ethoxylate[1] | 20.4 | 20.4 |
| Polyglycoside A[2] | 20.4 | — |
| Polyglycoside B[3] | — | 20.4 |
| Distilled Water | 47.2 | 47.2 |

TABLE 8-continued

| Microemulsion Compositions | | |
|---|---|---|
| Components | Composition F | Composition G |

[1]Ethoxylate is available under the name Surfonic 24-5 from Huntsman Chemical.
[2]Polyglycoside A is available under the name APG-625 from Henkel.
[3]Polyglycoside B is available under the name APG-600 from Henkel.

In the sample preparations, ingredients were added in the order as shown. Each mixture was then stirred and heated to just below 120° F. until all lumps were removed. Each mixture was then allowed to air-cool to room temperature. Composition F was a white milky mini-emulsion at 120° F., became clear at an intermediate temperature, and finally became very slightly cloudy when cooled to room temperature. Composition G maintained a slightly opaque appearance throughout the cooling cycle.

Composition F was tested in a self-serve car wash station. A test car was first subjected to a preliminary flush with water alone to remove some of the gross particulates, then was gently sponged with a test solution of 2 oz/gal of Formula F. The test car was then rinsed off with water alone. A shedding effect was observed during the final rinse, and enhanced drying was obtained. The car body paint dried to a nice shine, while the windshield dried to some, but not excessive water spots, with no film. Results were deemed excellent compared with other field test formulas, all the more remarkable considering that this is a nonionic surfactant-based formula with no chelating agents, water conditioners, or anionic surfactants.

The above discussion, examples and data provide a basis for understanding the disclosure. However, the invention can embody a variety of compositions and methods. The invention accordingly is found in the claims hereinafter appended.

We claim:

1. A microemulsion detergent composition comprising:

(a) an effective microemulsion forming amount of water;

(b) an effective microemulsion forming amount of a nonionic surfactant mixture comprising:

(i) $C_{6-24}$ alcohol ethoxylate surfactant having between about 1 to about 20 moles ethylene oxide residues;

(ii) $C_{6-24}$ alkyl polyglycoside surfactant having a degree of polymerization of between about 1 and about 10;

(iii) wherein the alcohol ethoxylate surfactant and the alkyl polyglycoside surfactant are provided at a weight ratio of between about 1:4 and about 4:1; and (c) an effective microemulsion forming amount of oil exhibiting a water solubility at 22° C. of less than one percent by weight, wherein the microemulsion detergent composition is substantially free of anionic surfactants.

2. A microemulsion detergent composition according to claim 1, wherein the water is present at a concentration of between about 30 wt. % and about 60 wt. %.

3. A microemulsion detergent composition according to claim 1, wherein the oil is present at a concentration of between about 1 wt. % and about 30 wt. %.

4. A microemulsion detergent composition according to claim 1, wherein the nonionic surfactant mixture is present at a concentration of between about 20 wt. % and about 60 wt. %.

5. A microemulsion detergent composition according to claim 1, wherein the ratio of alcohol ethoxylate surfactant to alkyl polyglycoside surfactant is between about 1:3 and about 3:1.

6. A microemulsion detergent composition according to claim 1, wherein the weight ratio of alcohol ethoxylate surfactant to alkyl polyglycoside surfactant is between about 1:2 and about 2:1.

7. A microemulsion detergent composition according to claim 1, wherein the ratio nonionic surfactant to oil is greater than about 1.4:1.

8. A microemulsion detergent composition according to claim 1, wherein the alcohol ethoxylate surfactant comprises a $C_{12-15}$ alcohol ethoxylate having between about four and about six moles ethylene oxide residues.

9. A microemulsion detergent composition according to claim 1, wherein the alkyl polyglycoside surfactant comprises a $C_{8-12}$ alkyl polyglycoside component having a degree of polymerization of between about 1 and about 5.

10. A microemulsion detergent composition according to claim 1, further comprising an amphoteric surfactant.

11. A microemulsion detergent composition according to claim 10, wherein the amphoteric surfactant is provided at a concentration of between about 1 wt. % and about 20 wt. %.

12. A microemulsion detergent composition according to claim 1, further comprising an additive comprising at least one of antimicrobial agents, oxidative antimicrobial agents, corrosion inhibitors, and mixtures thereof.

13. A microemulsion detergent composition according to claim 12, wherein the oxidative antimicrobial agent comprises at least one of hydrogen peroxide, ozone, hypochloride, chlorine dioxide, and mixtures thereof.

14. A microemulsion detergent composition according to claim 1, wherein the microemulsion exhibits at, least a 90% transmission of visible light through a 1 cm cell compared with a 1 cm cell of deionized water.

15. A microemulsion detergent composition according to claim 1, wherein a microemulsion is maintained within a temperature range of about 50° F.

16. A microemulsion detergent composition according to claim 10, wherein the amphoteric surfactant comprises a compound of the formula:

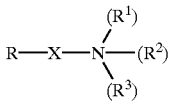

wherein

X is a linear or branched alkylene, hydroxyalkylene or alkoxyalkylene group having 1–4 carbon atoms;

R is $R^4$—CO—NH in which $R^4$ is a saturated or unsaturated, branched or linear alkyl group having 4–22 carbon atoms, or $R^4$;

$R^1$ is hydrogen, A or $(A)_n$—X—$CO_2^-Z^+$ in which A is a linear or branched alkyl, hydroxyalkyl or alkoxyalkyl having 1–4 carbon atoms, n is an integer from 0 to 6, and Z is an alkali metal cation, a hydrogen ion or an ammonium cation;

$R^2$ is $(A)_n$—X—$CO_2^-Z^+$; and $R^3$ is absent or A.

17. A microemulsion detergent composition according to claim 10, wherein the amphoteric surfactant comprises a compound of the formula:

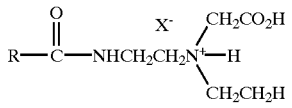

where R is hydrogen, straight or branched alkyl having 1 to 16 carbon atoms, in which the alkyl group is uninterrupted or interrupted by phenyl, and X is an anion.

18. A microemulsion detergent composition according to claim 10, wherein the composition comprises a pH of less than 7.

19. A method of removing hydrophobic soil from an article, the method comprising a step of:

contacting an article containing a hydrophobic soil with a microemulsion detergent composition, wherein the microemulsion detergent composition comprises:

(a) an effective microemulsion forming amount of water;

(b) an effective microemulsion forming amount of a nonionic surfactant mixture comprising:

(i) $C_{6-24}$ alcohol ethoxylate surfactant having between about 1 to about 20 moles ethylene oxide residues;

(ii) $C_{6-24}$ alkyl polyglycoside surfactant having a degree of polymerization of between about 1 and about 20;

(iii) wherein the alcohol ethoxylate surfactant and the alkyl polyglycoside surfactant are provided at a weight ratio of between about 1:4 and about 4:1; and (c) an effective microemulsion forming amount of oil exhibiting a water solubility at 22° C. of less than one percent by weigh; wherein the microemulsion detergent composition is substantially free of anionic surfactants.

20. A method of removing hydrophobic soil from an article according to claim 19, wherein the hydrophobic soil comprises a hydrocarbon oil.

21. A method of removing hydrophobic soil from an article according to claim 20, wherein the hydrocarbon oil comprises a particulate soil.

22. A method of removing hydrophobic soil from an article according to claim 19, wherein the article comprises fabric.

23. A method of removing hydrophobic soil from an article according to claim 19, wherein the article comprises a substance having a hard surface.

24. A method of removing hydrophobic soil from an article according to claim 19, wherein the article comprises a motor vehicle exterior surface.

25. A method of removing hydrophobic soil from an article according to claim 24, further comprising a step of:

(a) rinsing the microemulsion detergent composition from the motor vehicle exterior surface.

26. A method of removing hydrophobic soil from hands, the method comprising a step of:

contacting hands soiled with a hydrophobic soil with a microemulsion detergent composition comprising:

(a) an effective microemulsion forming amount of water;

(b) an effective microemulsion forming amount of a nonionic surfactant mixture comprising:

(i) $C_{6-24}$ alcohol ethoxylate surfactant having between about 1 to about 20 moles ethylene oxide residues;

(ii) $C_{6-24}$ alkyl polyglycoside surfactant having a degree of polymerization of between about 1 and about 20;

(iii) wherein the alcohol ethoxylate and the alkyl polyglycoside are provided at a weight ratio of between about 1:4 and about 4:1; and (c) an effective microemulsion forming amount of oil exhibiting a water solubility at 22° C. of less than one percent by weight; wherein the microemulsion detergent composition is substantially free of anionic surfactants.

27. A method for phase inverting a microemulsion, the method comprising the steps of:

providing a microemulsion use solution comprising:

(a) an effective microemulsion forming amount of water;

(b) an effective microemulsion forming amount of a nonionic surfactant mixture comprising:

(i) $C_{6-24}$ alcohol ethoxylate surfactant having between about 1 to about 20 moles ethylene oxide residues;

(ii) $C_{6-24}$ alkyl polyglycoside surfactant having a degree of polymerization of between about 1 and about 20;

(iii) wherein the alcohol ethoxylate and the alkyl polyglycoside are provided at a weight ratio of between about 1:4 and about 4:1;

(c) an effective microemulsion forming amount of oil exhibiting a water solubility at 22° C. of less than one percent by weight; and (d) a splitting effective amount of a splitting agent; and altering the temperature of the use solution to cause the microemulsion to split; wherein the microemulsion use solution is substantially free of anionic surfactants.

* * * * *